United States Patent [19]

O'Connor et al.

[11] Patent Number: 4,848,204

[45] Date of Patent: Jul. 18, 1989

[54] DIE CUTTER BLANKET

[75] Inventors: Barry J. O'Connor, Anderson, Ind.; Robert B. Vigder, Dayton, Ohio

[73] Assignee: Corfine Inc., Muncie, Ind.

[21] Appl. No.: 209,721

[22] Filed: Jun. 22, 1988

[51] Int. Cl.[4] ..... B26D 7/20

[52] U.S. Cl. ..... 83/659; 83/347; 83/698

[58] Field of Search ..... 83/347, 659, 698; 29/118, 129, 129.5; 101/415.1

[56] References Cited

U.S. PATENT DOCUMENTS

| | | | |
|---|---|---|---|
| 3,765,329 | 10/1973 | Kirkpatrick et al. | 83/659 X |
| 3,885,486 | 5/1975 | Kirkpatrick et al. | 83/659 |
| 4,031,600 | 6/1977 | Whigham | 83/659 X |
| 4,073,207 | 2/1978 | Kirkpatrick | 83/659 |

*Primary Examiner*—Frank T. Yost
*Assistant Examiner*—Eugenia A. Jones
*Attorney, Agent, or Firm*—Biebel, French & Nauman

[57] ABSTRACT

A replaceable cover for the cylindrical anvil of a rotary die cutter includes a blanket body of elastically deformable material, a sheet metal liner for the blanket body, and a latch assembly for securing the ends of the cover together in a slot in the face of the anvil roll. This latch assembly includes a channel bar having one side welded to one end of the blanket liner so that the open side of the channel faces the other end of the assembly for interlocking cooperation with a latch member integrally formed on the blanket body. The interior of the channel is filled with the material of the blanket body, and special provision is also made to provide a metal-reinforced supporting surface for the circumferentially interfitting parts of the latch assembly.

5 Claims, 3 Drawing Sheets

DIE CUTTER BLANKET

BACKGROUND OF THE INVENTION

This invention relates to a blanket assembly for use as a replaceable cover for the cylindrical anvil of a rotary die cutter or the like to support the sheet or web material being cut by the die or dies carried by the complementary rotary die cylinder, as shown, for example, in our U.S. Pat. No. 4,716,802. The invention has particular relation to a new and improved latch mechanism for securing a die cutter blanket of urethane or other elastically deformable material to the anvil roll of a rotary die cutter.

Typical prior art approaches to this problem are shown in Kirkpatrick et al U.S. Pat. Nos. 3,765,329 and 3,885,486, and in the prior commercial practice of the assignee of this invention, as discussed hereinafter in connection with the drawings. Each of these prior art latch mechanisms has practical disadvantages of complexity of construction and assembly, expense of production, and difficulty in use, as discussed in more detail hereinafter. The latch assembly of the present invention was accordingly developed to eliminate or overcome these disadvantages of prior art practice.

SUMMARY OF THE INVENTION

The primary object of the invention is to provide a latch assembly for the ends of a blanket for the anvil roll of a rotary die cutter or the like which is simpler and less expensive to produce than anything available for the purpose in the prior art, and which also imparts maximum firmness to the blanket lengthwise of the roll throughout the area overlying the latch mechanism. The particular structure by which these objectives are achieved is described in detail in connection with the preferred embodiment of the invention, wherein additional features and advantages provided by the invention are also pointed out.

BRIEF DESCRIPTION OF THE PREFERRED EMBODIMENT

Figure 1:
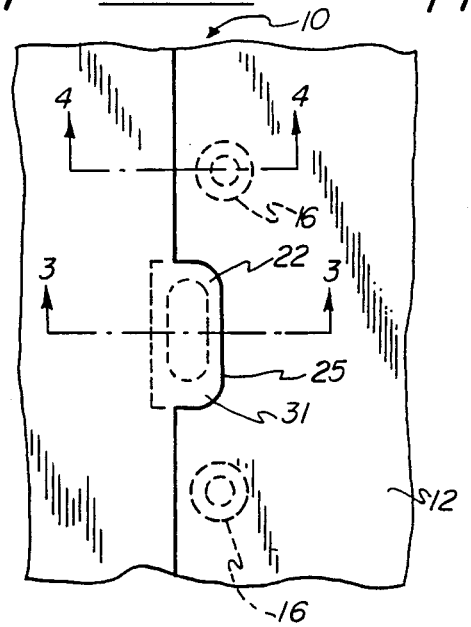
FIG-1 PRIOR ART
FIG. 1 is a fragmentary plan view of the face of a blanket assembly mounted on an anvil roll and embodying a latch mechanism either of a prior construction employed by the assignee of this invention or of the present invention.

The novel latch construction of the present invention is most readily described in the context of the closest prior art constructions known to the inventors. Thus in FIGS. 1–3, the blanket assembly 10 is mounted on an anvil roll 11 and comprises a blanket body 12, which is molded of polyurethane or comparable elastically deformable material, and a liner sheet 13, which is commonly of steel and is intimately bonded to the blanket body during the molding process. Blanket assemblies of this type are made in many predetermined sizes to fit correspondingly sized anvil rolls, and the art has provided many different mechanisms for securing the opposed ends of such blanket assemblies together on the appropriately sized anvil roll.

On such latch assembly is shown in FIGS. 1–4 as including a latch bar 15 of essentially square cross section which is secured to one end of the liner sheet 13 by multiple rivets 16. This latch bar 15 fits in and is secured to the bottom of a slot 20 which extends the full length of the face of roll 11. More specifically, the latch bar 15 includes a flange portion 22 having a slot 23 therein for adjustably receiving a screw or bolt 24 by which the bar is anchored in the slot 20. The bar 15 also includes a recessed portion 25 of generally half-oval shape above the flange portion 22 to provide access to the screw 24 and also to expose enough of flange 22 to provide support for the screw head on both sides of slot 23.

Figure 2:
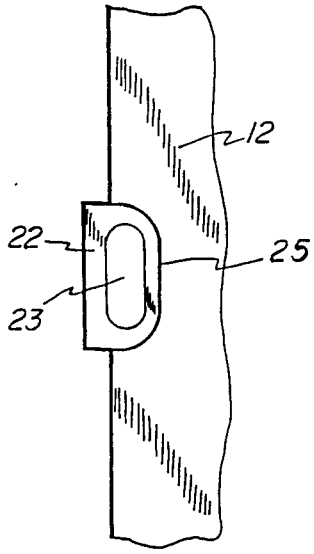
FIG-2 PRIOR ART
FIG. 2 is a plan view of the right hand fragment of the assembly shown in FIG. 1.
Figure 3:
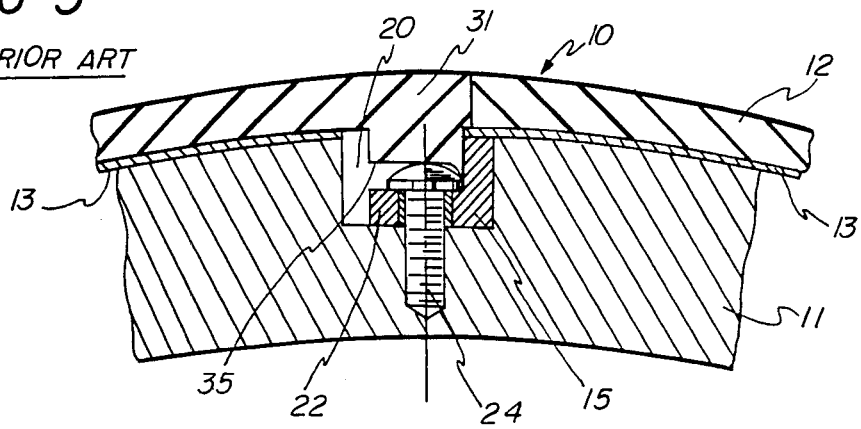
FIG-3 PRIOR ART
FIG. 3 is an enlarged fragmentary section on the line 3—3 of FIG. 1 illustrating the prior construction.

The other end of the blanket 10 includes a latch portion 30 which is of the same material as the blanket body 11 and is integrally formed therewith during the same molding process by which the blanket body 11 is formed and secured to the liner sheet 13. As shown in FIGS. 2 and 3, the liner sheet extends to a location just short of the latch portion 30 so that there is solid plastic material extending from the outer surface of the blanket body to the inner edge of the latch 30.

Except for its nose portion 31, the latch 30 is of uniform cross sectional dimensions and is proportioned to fit forcibly in the space in the slot 20 between the bar 15 and the opposing wall 33 of the slot. As shown in FIGS. 1 and 2, the nose portion 31 is proportioned to fill the recess 25 above the flange portion 22 of the bar 15, and it is recessed at 35 on its under surface to fit over and seat on the head of the screw 24. In addition, the latch bar 15 includes a narrow shoulder 36 which interfits with a complementary shoulder 37 on the latch portion 30 of the blanket body.

This prior construction has proved to be fully acceptable in the trade, but it does exhibit several practical disadvantages. In the first place, the bar 15, which is machined from aluminum bar stock, represents a substantial expense from the standpoint of the amount of metal therein, the labor involved in machining and attaching it to the cover sheet 13 is another significant cost item. Also, the heads of the rivets 16, which must be of substantial size as shown, compel a reduced thickness of the urethane overlying them, and this produces weak spots which reduce the service life of the blanket. Further, the bar 15 presents a metal surface to the latch 30 which offers frictional resistance to the latch 30 during mounting of the blanket on an anvil when this latch must be pounded into the open portion of the slot 20 between bar 15 and the slot wall 33 to the position shown in FIG. 2.

Figure 4:
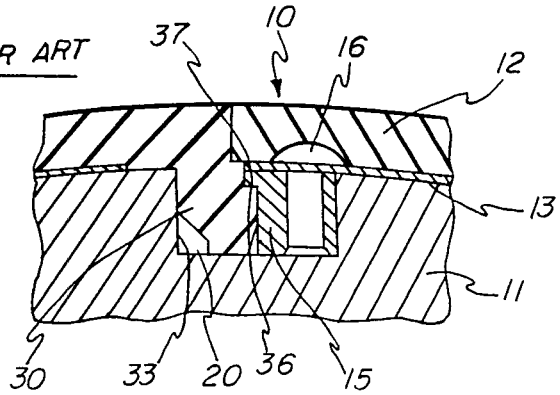
FIG-4 PRIOR ART
FIG. 4 is an enlarged fragmentary section on the line 4—4 of FIG. 2 and illustrating the prior latch construction.
Figure 5:
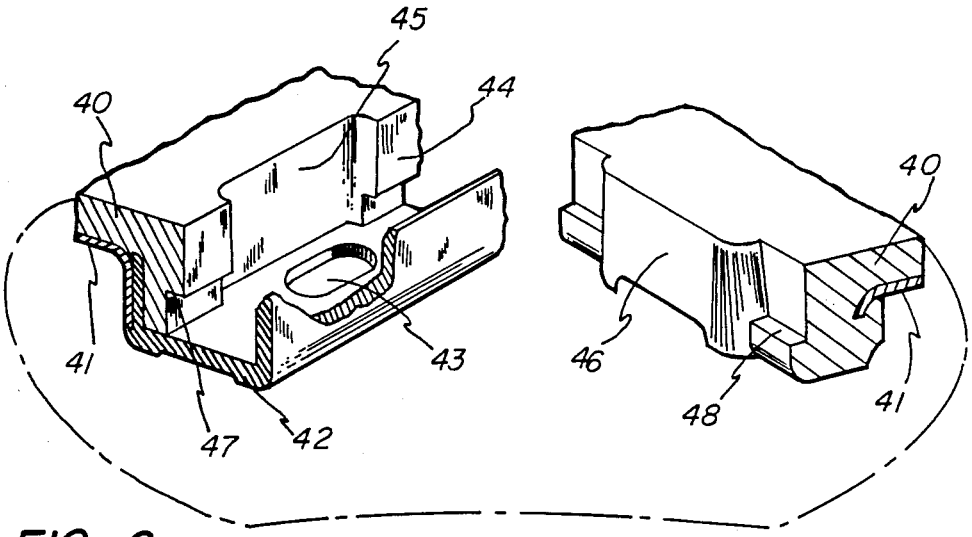
FIG-5 PRIOR ART
FIG. 5 is a reproduction of the drawing of Kirkpatrick et al U.S. Pat. No. 3,885,486.
Figure 6:
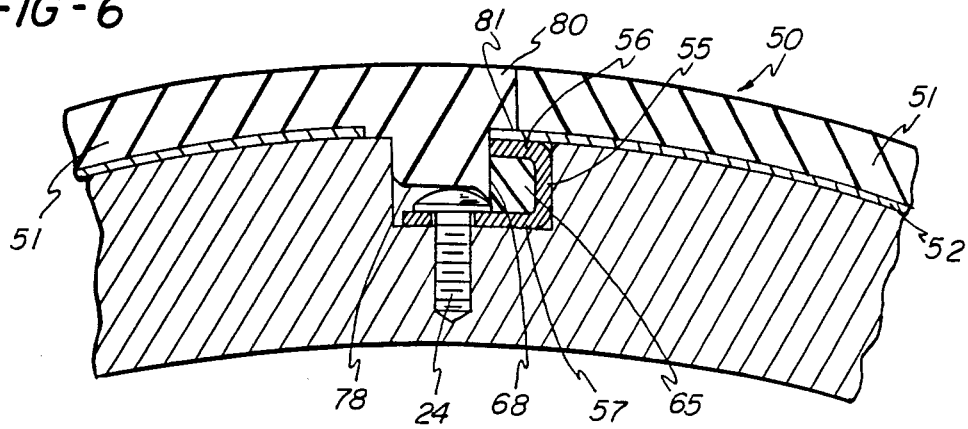
FIG. 6 is a view similar to FIG. 3 illustrating the latch mechanism of the present invention.
Figure 7:
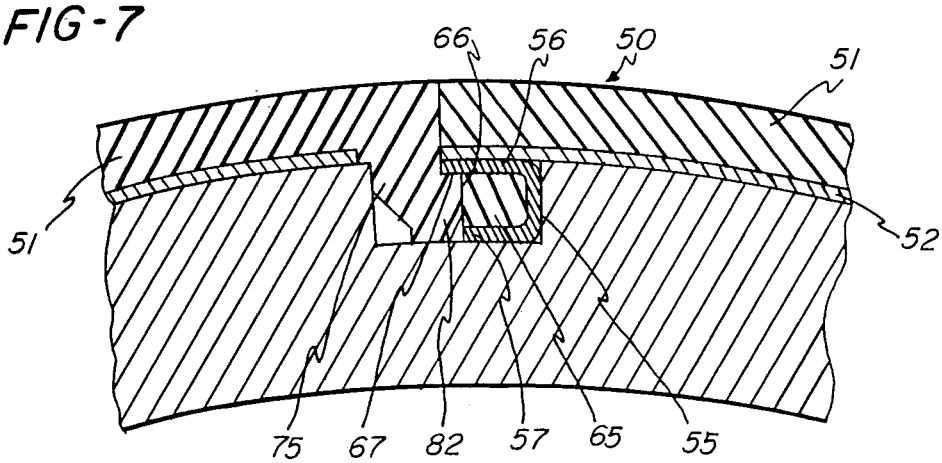
FIG. 7 is a view similar to FIG. 4 illustrating the latch mechanism of the present invention.
Figure 8:
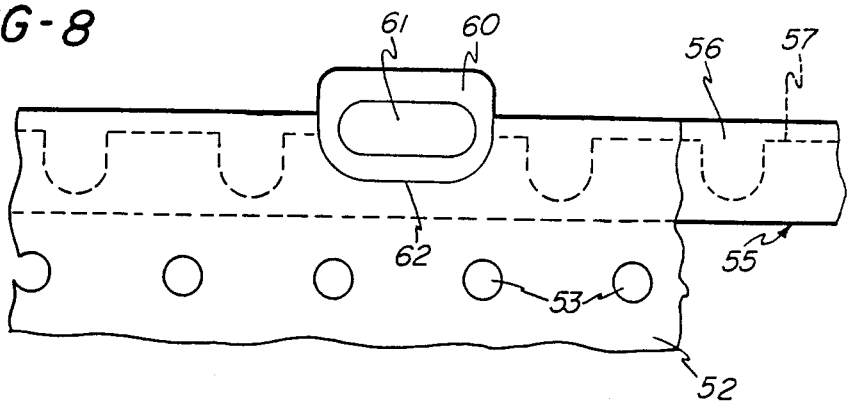
FIG. 8 is a fragmentary view of the radially outer side of the reinforcing liner of the blanket shown in FIGS. 6–7 prior to incorporation thereof in the blanket.

Another latch construction which has been available for some years is shown in FIG. 5, wherein the blanket assembly includes a blanket body 40 and liner sheet 41 which correspond to the blanket body 11 and liner sheet 13 in FIGS. 1–3, but the latch assembly is otherwise quite different. Its primary member is a channel-shaped mounting member 42 proportioned to fill a slot in an anvil roll corresponding to the slot 20 in FIGS. 3–4. This channel member is secured to the liner sheet 41 by forming one end of the sheet 41 inwardly and riveting it to the outer surface of one of the side walls of the member 42, and the bottom wall of member 42 has a slot 43 therein for receiving a mounting screw corresponding to the screw 24 in FIG. 3.

The blanket body 40 includes a portion 44 which extends into and partially fills the interior of the channel member 42, but which is provided with a recess 45 corresponding in function and location to the recess 25 in FIGS. 3 and 4. At the other end of the blanket assembly, the blanket body includes an integrally formed latch portion 46 proportioned to be received in the recess 45 and the remainder of the space within the channel member 42 which is left empty by the portion 44 of the blanket body. Shoulders 47 and 48 on the parts 44 and 46 are proportioned to interlock after the latch portion 46 has been fully inserted in the channel member 42.

This latch assembly as shown in FIG. 5 also has practical disadvantages. For example, the channel member 42 presents three metal surfaces in face to face relation with the bottom and sides of the receiving slot in the anvil roll, and the latch portion 46 is received in this channel member rather than in the empty portion of the slot as is done with the assembly of FIGS. 1–4. This requires an otherwise unnecessarily high degree of precision in matching the corresponding dimensions of the channel member 42 and the slot therefor in the anvil roll.

Another problem arises from the fact that the portion 44 of the blanket body which extends into the channel member 42 has no reinforcement above the bottom of member 42. Further, the shoulder 47 is in effect cantilevered with respect to the bottom wall of channel member 42, and is thus supported against the cutting force of the dies on the die cylinder only by the shoulder portion 48 of the latch 46. In practice, this arrangement has been found to provide a distinctly different level of support of the blanket with respect to the die or dies on the die cylinder as compared with the remainder of the blanket. In other words, the result appears to be what may be termed a "soft" streak extending across the full length of the blanket assembly in radial alignment with the slot in the roll wherein the latch assembly is anchored.

Referring now to FIGS. 6–10, the blanket assembly 50 comprises a blanket body 51, preferably of polyurethane, and a liner sheet 52 which is secured to the blanket body 51 while the latter is being molded in the usual way. The holes 53 in liner 52 are filled with the body material which also forms a thin cover layer on the inner surface of the liner to promote the adhesion between the liner and the blanket body.

At one end of the blanket assembly is a bar 55, which is essentially in the form of a channel having one side wall 56 welded to the undersurface of the liner 52 so that its open side faces the other end of the blanket assembly. The radially inner side wall 57 of channel bar 55 includes a flange portion 60 which corresponds to the flange 22 in FIG. 2 and has therein a slot 61 for a mounting screw 24, and the liner 52 and the outer wall 56 of the bar are recessed at 62 to provide for access to the screw 24.

Figure 9:
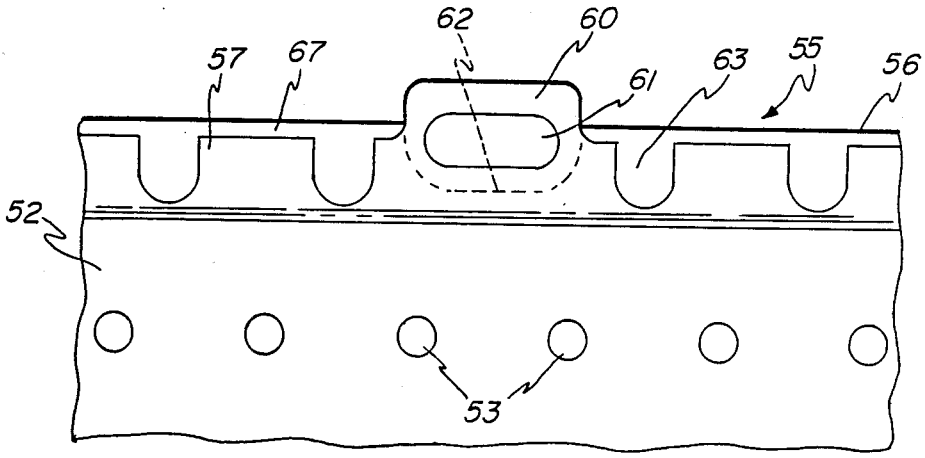
FIG. 9 is a view similar to FIG. 8 of the inner side of the reinforcing liner.
Figure 10:
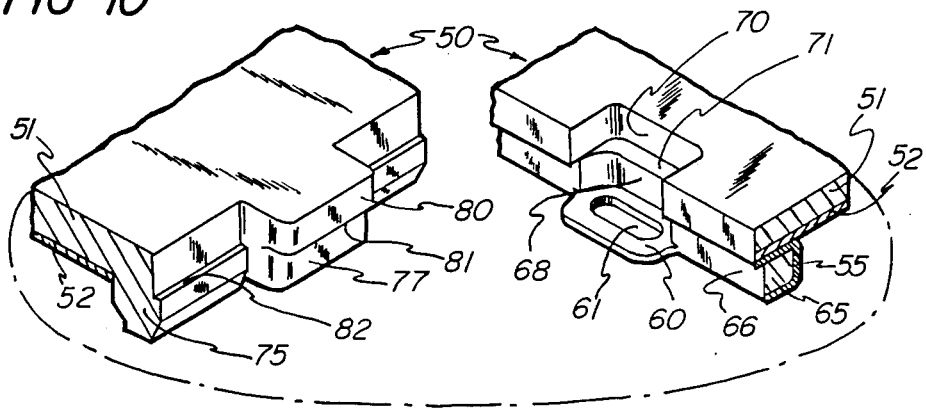
FIG. 10 is a view similar to FIG. 5 showing the latch portions of the assembly of FIGS. 6–7.

The multiple notches 63 in the edge of the inner side wall 57 of bar 55 serve to admit a welding electrode during the welding of the other side 56 of bar 55 to the liner 52. During the molding of the blanket body 51, the interior of the channel bar 55 is filled with the same material 65 as the blanket body to prevent a polyurethane surface 66 facing the opposing wall 33 of the slot 20 in the anvil roll 11, and the material 65 also fills the notches 63. As best seen in FIG. 9, the inner channel wall 57 is somewhat shorter than the opposing outer wall 56, e.g. by a margin of approximately 0.100 inch, to provide an overhanging shoulder 67 along the upper edge of the surface 66 which extends to the end of the blanket body and the liner 52.

With this construction, the portion of the blanket body which extends above the slot 20 in the anvil roll is directly supported by the metal provided both by the liner 52 and the channel wall 56, as contrasted with the absence of metal support in the corresponding portion of the patented construction shown in FIG. 5. The surface 66 is provided with a recess 68 like the recess 22 in FIGS. 1 and 2 which exposes the area of flange 60 surrounding the slot 61. In addition, the adjacent end of the blanket body 51 is provided with a recess 70 deeper than the recess 68 to provide a seat 71 on the outer surface of the channel wall 56 and/or the adjacent upper surface of the liner 52 which surrounds the outer end of the recess 68.

The other end of the blanket assembly includes a latch portion 75 which is similar in configuration to the latch portion 30 in FIG. 3. It includes a nose portion 77 which is proportioned to fill the inner recess section 68 in the material filling the channel bar 55, and it has a recessed portion 78 on its inner side that overhangs and can rest on the head of screw 24. In addition, the nose 77 includes a portion 80 which fills the deeper recess section 70 in the opposed end of the blanket body and forms an overhanging shoulder 81 proportioned to engage the seat area 71 on the channel side wall 56.

As a result of this structural arrangement, nose portion 80 is provided with firm, metal-reinforced, support which effectively eliminates the soft spot in this portion of the blanket assembly that has been a problem in prior art constructions. Further, while the latch portion 75 includes a shoulder 82 proportioned to fit under the shoulder 67, this interfitting relation does promote the latching action, but the shoulder 82 is not required to contribute support to any of the force applied to the blanket in use, because the portion of the blanket body which overlies the channel bar 55 is supported by the channel wall 56 and the overlying portion of liner 52, which prevents force applied to this end portion of the blanket body from affecting the interfitting shoulders 67 and 82.

While the same advantage in use is provided by the prior construction shown in FIGS. 1–3, the construction of the present invention provides the further advantages noted above of simplicity and economy of construction as well as eliminating the heavy square bar of the prior construction. Further, the replacement of the rivets 16 by spot welded connections eliminated thin spots in the blanket body and correspondingly increased its service lipe. Also, it has been found that with the material 65 filling the channel bar and presenting the surface 66 to the latch portion 75, mounting of the blanket assembly of the invention on an anvil roll is significantly facilitated, because the latch member 75 can be fitted into place more easily when it is sliding against a surface of the same material than against a metal surface as in FIGS. 2 and 3.

While the form of apparatus herein described constitutes a preferred embodiment of the invention, it is to be understood that the invention is not limited to this precise form of apparatus and that changes may be made therein without departing from the scope of the invention which is defined in the appended claims.

What is claimed is:

1. A blanket assembly for an anvil roll for rotary die cutting having cylindrical periphery and an axially extending slot in said cylindrical periphery thereof, comprising:

(a) a blanket body of elastically deformable material proportioned to fit around the anvil and having radially inner and outer sides and opposed ends which meet each other to define a cylindrical sleeve in a mounted position of said blanket body on the anvil roll, (b) said blanket body including a metal liner sheet having radially inner and outer surfaces and extending substantially from end to end of said radially inner side of said blanket body.

(c) means at one end of said linear defining a channel having radially inner and outer side walls parallel with said liner and an open side thereof facing the other end of said blanket body with a portion of said blanket body overlying said channel, (d) said channel being proportioned to fit within a portion of said anvil roll slot along one side thereof while leaving the remaining portion of said slot empty, (e) said channel having an opening through said radially inner side wall thereof for receiving a screw for securing said wall to the bottom of said slot, (f) said elastically deformable material of said blanket body extending into and filling said channel except for a recess therein overlying said screw opening, and (g) the other end of said blanket body including an integrally formed latch of said elastically deformable material extending radially inwardly thereof and proportioned to fill said empty portion of said anvil slot between said channel and the other side of said slot and also to fill said recess in said material filling said channel.

2. A blanket assembly as defined in claim 1 wherein said channel is initially separate from said linear sheet and has said radially outer side wall thereof secured to the radially inner surface of said liner sheet.

3. A blanket assembly as defined in claim 2 wherein said channel is welded to said liner sheet.

4. A blanket assembly as defined in claim 1 wherein said radially outer side wall of said channel extends beyond said radially inner side channel wall to provide support for the portion of said blanket body overlying said channel.

5. A blanket assembly as defined in claim 1 wherein said recess in said material filling said channel has radially inner and outer sections, said outer section extending radially from said liner to said outer side of said blanket body and being proportioned to expose a radially outwardly facing seal portion of said outer channel side wall within said outer recess section, and said latch includes a nose portion proportioned to fill said outer section of said recess and to engage and be supported by said seat portion.

* * * * *